United States Patent [19]

Pyles et al.

[11] Patent Number: 4,772,186

[45] Date of Patent: Sep. 20, 1988

[54] AUTOMATIC FLUID TORQUE RESPONSIVE SHUT-OFF MECHANISM FOR AN AIR TOOL

[75] Inventors: Douglas E. Pyles; David N. Carey, both of Bryan, Ohio

[73] Assignee: The Aro Corporation, Bryan, Ohio

[21] Appl. No.: 831,133

[22] Filed: Feb. 18, 1986

[51] Int. Cl.[4] ..... F01C 21/12; G03D 13/10

[52] U.S. Cl. ..... 418/43; 418/270; 415/503; 173/163; 137/53

[58] Field of Search ..... 418/266–270, 418/40–43; 415/503; 173/163; 137/53, 56, 599

[56] References Cited

U.S. PATENT DOCUMENTS

| | | | |
|---|---|---|---|
| 810,890 | 1/1906 | Taylor | 418/270 |
| 2,114,813 | 4/1938 | Reynolds | 137/53 |
| 2,159,232 | 5/1939 | Shaff | 418/270 |
| 2,401,190 | 5/1946 | Reynolds | 418/270 |
| 2,636,513 | 4/1953 | Schmid | 418/270 |
| 2,691,382 | 10/1954 | Frick | 137/53 |
| 2,920,633 | 1/1960 | Shepherd | 137/53 |
| 3,077,921 | 2/1963 | Zubaty | 137/53 |
| 3,241,567 | 3/1966 | Pusch | 137/599 |
| 3,298,284 | 1/1967 | Alexander | 418/270 |
| 3,429,230 | 2/1969 | Quackenbush | 418/270 |
| 3,439,422 | 4/1969 | Doeden | 418/270 |
| 3,614,275 | 10/1971 | Eibsen | 418/270 |
| 3,718,410 | 2/1973 | Berger | 418/270 |
| 4,484,871 | 11/1984 | Adman | 418/270 |
| 4,549,571 | 10/1985 | Kelly | 137/599 |

FOREIGN PATENT DOCUMENTS

| | | | |
|---|---|---|---|
| 648086 | 9/1962 | Canada | 137/53 |
| 856831 | 12/1960 | United Kingdom | 418/43 |

*Primary Examiner*—Carlton R. Croyle
*Assistant Examiner*—Jane E. Obee
*Attorney, Agent, or Firm*—Allegretti, Newitt, Witcoff & McAndrews, Ltd.

[57] ABSTRACT

An improved torque control mechanism for a rotary vane, air motor tool includes acceleration and speed responsive slidable elements positioned in grooves that lie in a plane transverse to the spin axis of the motor and which form an angle with the radii extending from the spin axis. The elements cooperate with a cam plate which operates a fluid supply valve to close off air supply to the tool whenever torque of the tool causes the speed of the motor to decrease below a threshold level. A bypass valve and passage is manually operable to initiate operation of the air motor. An auxiliary low volume, low pressure valve and passage permits an operator to provide minor adjustments of the orientation of the output shaft of the tool. For reverse operation, the speed and acceleration control is eliminated by operation of a reverse operation control mechanism.

5 Claims, 6 Drawing Sheets

FORWARD ORIENTATION

REVERSE ORIENTATION

AUTOMATIC FLUID TORQUE RESPONSIVE SHUT-OFF MECHANISM FOR AN AIR TOOL

BACKGROUND OF THE INVENTION

This invention relates to an improved, fluid driven tool and more particularly to an air tool of the type having a rotary vane, air motor with an improved automatic fluid shut-off mechanism for controlling the flow of inlet fluid to the motor.

Rotary vane air motors are often incorporated in air tools such as nut runners, screwdrivers and the like. Typically such air tools incorporate a rotary vane air motor which operates in response to a manually operated pneumatic control valve. The air motor drives a central shaft which serves as the output shaft for the tool.

Heretofore various mechanisms had been proposed for controlling the speed of such tools by automatically shutting the rotary vane air motor off if the motor operates at an excessive speed. Mechanisms have also been proposed to control the torque output of such a motor and to provide other various control features in association with such a motor.

Nonetheless, there has remained a need for improved controls associated with such air tools. Among the controls desired is a mechanism which will automatically turn the tool off consistently when the torque output of the tool reaches a predetermined value. Additionally, it is desirable to provide a rotary shaft tool which will operate in reverse wihout torque control. Further, a feature desired for such tools is a mechanism for bypassing the torque control mechanism and to permit start up of the air tool without a complicated reset mechanism. In sum, an improved torque control mechanism is desired for incorporation in a rotary vane air motor tool of the type having a single output shaft mounted on bearings.

SUMMARY OF THE INVENTION

Briefly, the present invention comprises an improved torque control mechanism for a fluid driven tool of the type having a housing with a rotary vane, fluid driven motor mounted within the housing and having a longitudinal output shaft defining an axis of rotation extending longitudinally with respect to the tool. A fluid inlet passage is provided to the motor, and a fluid control valve mechanism is provided in that inlet passage. The improvement of the invention relates to an automatic fluid shut-off mechanism in the inlet passage which is responsive to torque output sensed by the tool. The mechanism includes a guide member which is keyed for rotation with the output shaft of the motor. The guide member includes a face generally transverse to the shaft rotation axis with at least one guide groove in the face. That guide groove defines a path which intersects a radius extending from the axis. The groove is thus "non-radial". An element slides in the groove between an inner position and an outer position in response to various acceleration forces acting on the element as the element and guide member rotate about the shaft.

A plate member, which defines a cam surface, is positioned against the slidable element and is mounted on the shaft for movement parallel to the axis in response to sliding movement of the element in the groove. In other words, the element moves against the cam face and thus moves the plate member. This causes the plate member to move between a first position corresponding to the inner position of the slidable element in the groove adjacent the axis and a second position corresponding to the outer position of the slidable element in the groove.

A main valve member is connected to the plate member and positioned in the inlet passage for cooperation with a valve seat. When the plate member and associated main valve member are moved toward the first position in response to the cooperative action of the slidable element with the plate member, the inlet passage is sealed inasmuch as the main valve member is seated on the associated valve seat. Otherwise, when the slidable element causes the plate member to move toward the second position, the main valve member is simultaneously moved and unseated or opened in order to permit fluid flow through the inlet passage to the rotary, fluid driven motor.

As a further feature of the invention, a bypass valve mechanism is provided to initially bypass the main valve member and direct pressurized fluid to the motor thereby initiating operation of the motor. This permits the motor to reach a speed at which the slidable element moves from the first position toward the second position to move the plate member and thus open the main valve member. Once the main valve member is opened, the bypass valve mechanism closes and automatically resets itself. The bypass valve mechanism thus operates in response to initial manual actuation of a manual control lever for the tool.

Yet another feature of the invention comprises an auxiliary fluid flow control mechanism for providing reduced volume and reduced pressure fluid to the motor when the manual control lever is initially and partially operated or depressed. This permits slight rotational operation of the air motor for alignment of the output spindle of the tool. This becomes necessary, for example, during initial alignment of the operative end of the tool on a nut, bolt, fastener or the like. When an auxiliary fluid flow control mechanism is operative, the bypass valve mechanism is inoperable and the air motor operates at such a low speed that the first or main valve member also remains unopened.

Yet another feature of the invention is a means for reversing the operation of the motor. When the means for reversing operation of the motor is effected, the main valve member is automatically opened or unseated from the main valve seat and reverse operation of the motor is under full air inlet pressure without any torque control.

Thus, it is an object of the invention is to provide an improved fluid driven tool control mechanism.

Yet a further object of the invention is to provide an improved air tool control mechanism which incorporates an automatic shut-off feature responsive to sensing of torque.

A further feature of the invention is to provide an improved air tool having an air or fluid bypass mechanism for initial start up of the air motor prior to operation of a torque sensing mechanism.

Yet a further feature of the invention is to provide an air tool having an auxiliary passage to permit low pressure and low volume flow operation of the tool without torque sensing capability.

Yet a further object of the invention is to provide an air tool which operates in reverse and which bypasses or avoids implementation of the torque control feature of the invention when operating in reverse.

Yet another object of the invention is to provide an improved control mechanism for a fluid driven tool including a torque control mechanism for a rotary vane air motor which utilizes a minimum number of parts yet which maintains a great variety of features, which is compact, durable, and which does not require disassembly to reset the torque control mechanism.

Still another object of the invention is to provide a torque control mechanism for a rotary valve, fluid driven motor which is generally concentric with the rotation axis of the motor.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Construction of the Air Tool

Figure 1:
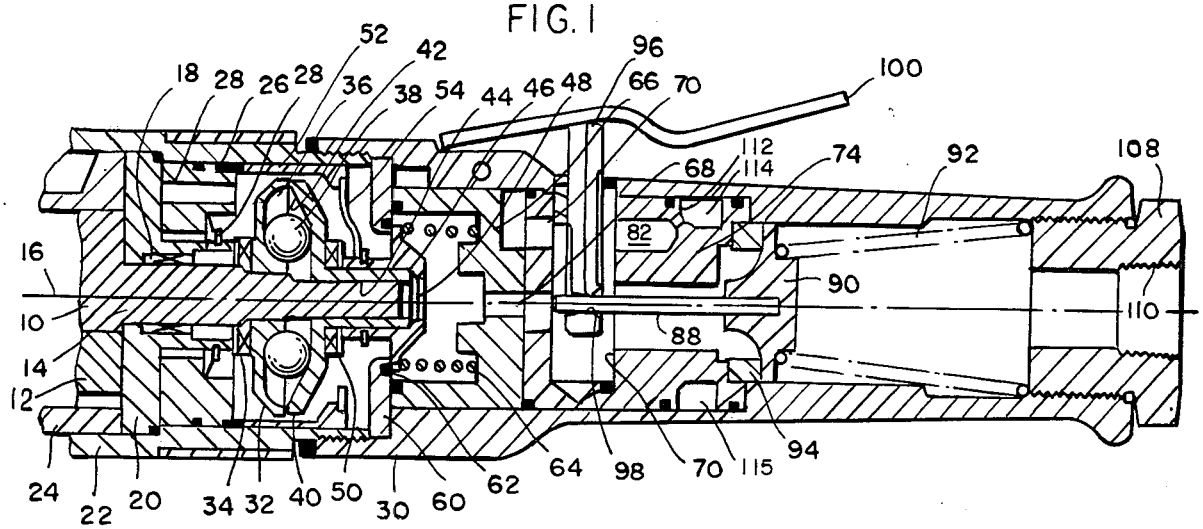
FIG. 1 is a cross sectional view of the improved control mechanism of the invention as incorporated with an air tool of the type having a rotary vane air motor.

The figures disclose a portion of a typical air tool. Thus referring to FIG. 1, there is disclosed that part of an air tool comprising a rotary vane air motor having a rotor 10 which receives a series of vanes, such as vane 12, and wherein a center mounting shaft 14 of the rotor 10, which projects along a longitudinal or center line axis 16, is mounted on bearings 18 in plate 20. The shaft 14 projects in the opposite direction from rotor 10 providing an output drive shaft for operating a tool bit in the manner known to those of skill in the art.

The plate 20 is appropriately mounted in a housing 22 that defines a shaped cylinder 24 in which the rotor 10 and vanes 12 rotate as they are driven by air or fluid pressure. An annular inlet control ring 26 is retained on the hub of plate 20 by means of a retention spring 28. The control ring 26 is also depicted in FIGS. 9, 10, 11 and 12 and may be rotated about the axis 16, as described below, to control forward or reverse operation of the air tool.

An air inlet passage 28 is defined through the ring 26 and when aligned with an appropriate opening in plate 20 provides an air or fluid passage to the cylinder 24 by which operation of the air motor is effected in a manner known to those skilled in the art. As depicted in FIG. 1, fluid flow through passage 28 effects forward operation of the tool.

Figure 8:
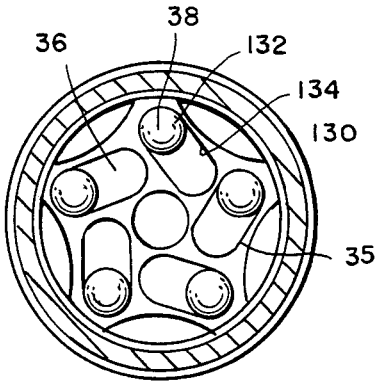
FIG. 8 is a transverse cross sectional view of the air tool taken substantially along the line 8—8 in FIG. 2.
Figure 9:
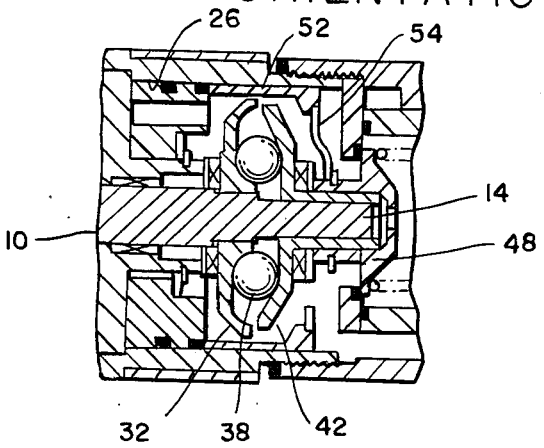
FIG. 9 is an enlarged partial cross sectional view of the torque control mechanism for the air tool illustrating the arrangement of the component parts of the air tool for forward operation thereof.

The housing 22 is coupled with a handle assembly 30 which retains the component parts in an assembled condition. Thus, mounted on the shaft 14 is a ball guide 32 as also depicted in FIG. 8, having a generally circular configuration. Ball guide 32 is keyed to the shaft 14 and is mounted against bearings 34 so that the guide 32 can rotate with the shaft 14. The guide 32 includes a generally planar surface 35 transverse to the axis 16 with a series of grooves 36. A slidable element or ball bearing 38 is positioned in each groove 36. Thus, one ball bearing 38 is positioned in each groove 36 as depicted in FIG. 8.

A cam plate 40 having a cam surface 42 fits against the slidable element 38. The cam plate 40 is annular having a longitudinal, circular cross section center passage 44 for receipt of the circular cross section end of shaft 14. Thus, the shaft 14 can rotate relative to the cam plate 40, and the plate 40 is also axially translatable on the shaft 14. Cam plate 40 includes a central projecting hub 46. Attached over the outside of the hub 46 of the plate 40 is a main valve member 48. The main valve member 48 is a generally circular disc with a central hub 58 having a counterbore for receipt of the hub 46. Roller bearings 50 permit the plate 40 to rotate relative to member 48. Since the hub 46 of plate 40 fits within the center conterbore of the main valve member 48, the plate 40 rotates relative to the valve member 48. In general the valve member 48 is fixed and does not rotate within the handle assembly 30. The plate member 40 may rotate relative to the valve member 48 and may also rotate relative to the ball guide 32.

Figure 10:
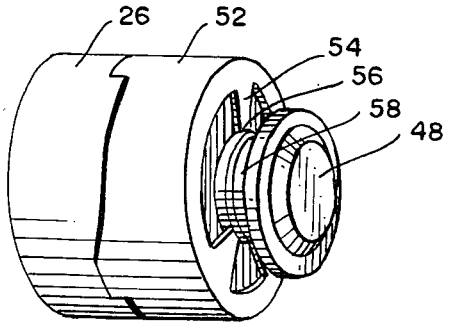
FIG. 10 is a side perspective view of component parts of the air tool illustrating their positioning for forward operation thereof, the component parts being shown in cross section in FIG. 9.
Figure 12:
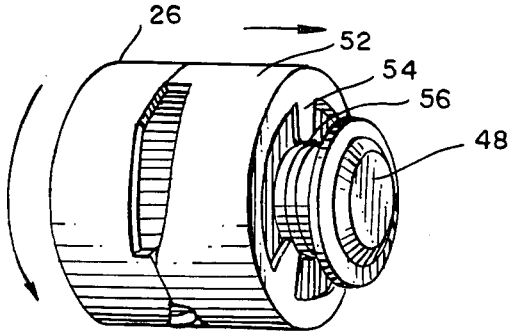
FIG. 12 is an enlarged perspective view of those component parts shown in FIG. 11 when configured for reverse operation of the tool.

A cylindrical, hollow control sleeve 52 fits against the inside of the housing 22 and includes arms 54 that project radially inward to engage against a locking ring 56 in a slot on the outside of the center hub 58 with valve member 48. This is also depicted in FIGS. 10 and 12.

A main valve seat plate 60 is fixed in the handle assembly 30 between the handle assembly 30 and the housing 22. The plate 60 is annular and an opening therethrough defines a main valve passage into which the hub 58 of the main valve element 48 is projected. A seal 62 on the sealing face of plate 60 adjacent the annular opening through the plate 60 cooperates with the valve member 48 and defines a seat for the valve member 48. The outer flange or edge of the valve member 48 is cooperative with a spring 64 maintained against outside face or upstream face of the valve member 48 by means of a central handle plug 66 fixed in position in the handle assembly 30.

The plug 66 includes a main air flow passage 68 and an auxiliary air flow passage 70. The main air flow passage 68 connects with or is in communication with the outer face of the main valve element 48 and permits air to impinge directly on that face. The auxiliary passage 70 extends through the plug 66 and connects to the chambers surrounding the ball guide 32 and cam plate 40. Air from this chamber, of course, passes through the inlet 28 to the motor to permit operation of the motor.

Figure 2A:
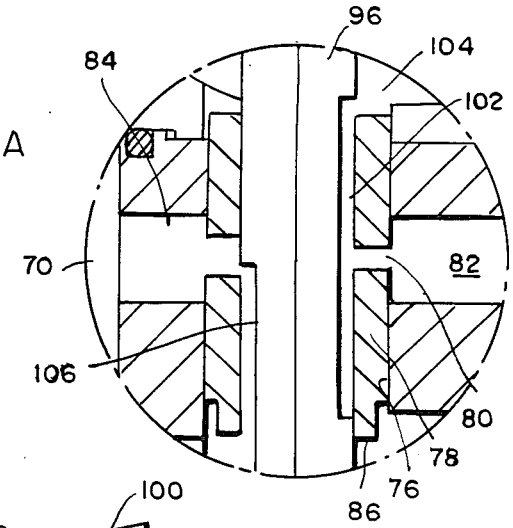
FIG. 2*a* is an enlarged cross sectional view of the slidable valve stem or poppet associated with the manual control lever for the improved control mechanism of the present invention depicted in FIG. 2.
Figure 2:
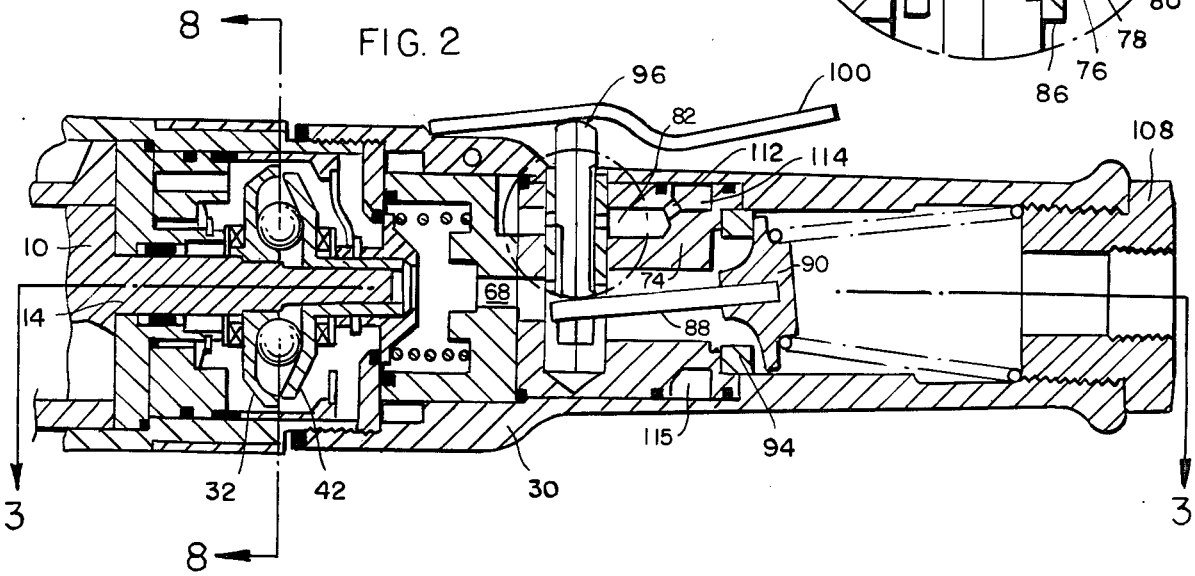
FIG. 2 is a side cross sectional view similar to FIG. 1 wherein the manual control lever associated with the air tool has been partially depressed less than half of its potential distance of travel to effect initial operation through an auxiliary inlet passage of the air tool to thereby permit low pressure and low volume operation of the air motor of the tool.

Axially adjacent and engaged against the plug 66 is a manual valve body assembly including a body 74 with a transverse, cylindrical stem assembly passage 76. FIGS. 2 and 2*a* illustrate in greater detail the construciton of the component parts positioned in the stem assembly passage 76. Referring to all of these figures, the stem assembly passage 76 includes a cylindrical sleeve 78 which projects into the passage 76 and includes a bypass control orifice 80 connected to a bypass passage 82 in the body 74. Sleeve 78 also includes an auxiliary orifice 84 connected to the auxiliary passage 70 through the body 74. The sleeve 78 includes a lower edge 86 which cooperates with a center rod 88 projecting axially from a circular valve 90. Valve 90 is biased by a spring 92 against an annular seat 94 retained by the body 74.

A slidable valve poppet or valve stem 96 is positioned within the sleeve 78. The stem 96 includes a transverse throughbore 98 for receipt of the rod or stem 88. In this manner the poppet 96 is biased or maintained in a fixed position by operation of spring 92 unless the force of the spring 92 is overridden by action of a pivotal manual lever 100 pivotally attached to the handle assembly 30. Thus, as shown in FIG. 1, the stem or poppet 96 is aligned so that the rod 88 and throughbore 98 are in alignment with the axis 16.

Importantly, poppet stem 96 includes a first, longitudinal air flow slot 102 which is aligned to connect orifice 80 with the interior chamber of the body 74 or alternatively with a passage 104 to the atmoshere. A second, longitudinal slot 106 on the opposite side of poppet 96 is also provided in the poppet or spool stem 96 and connects the main inlet of body 74 with orifice 84 in a manner to be described below.

The spring 92 and associated components are retained in position by a threaded plug insert 108 having an air inlet throughbore 110. Insert 108 is threaded into the cylindrical handle assembly 30. The throughbore 110 in insert 108 is connectable with an air supply source in a manner known to those skilled in the art. Thus, pressurized inlet air or fluid is provided through the throughbore 110 against the surface of the valve member 90. Prior to operation of the manual lever 100, the air pressure against the valve 90 acts to maintain the tool in the off position preventing air from flowing to the motor.

Figure 3:
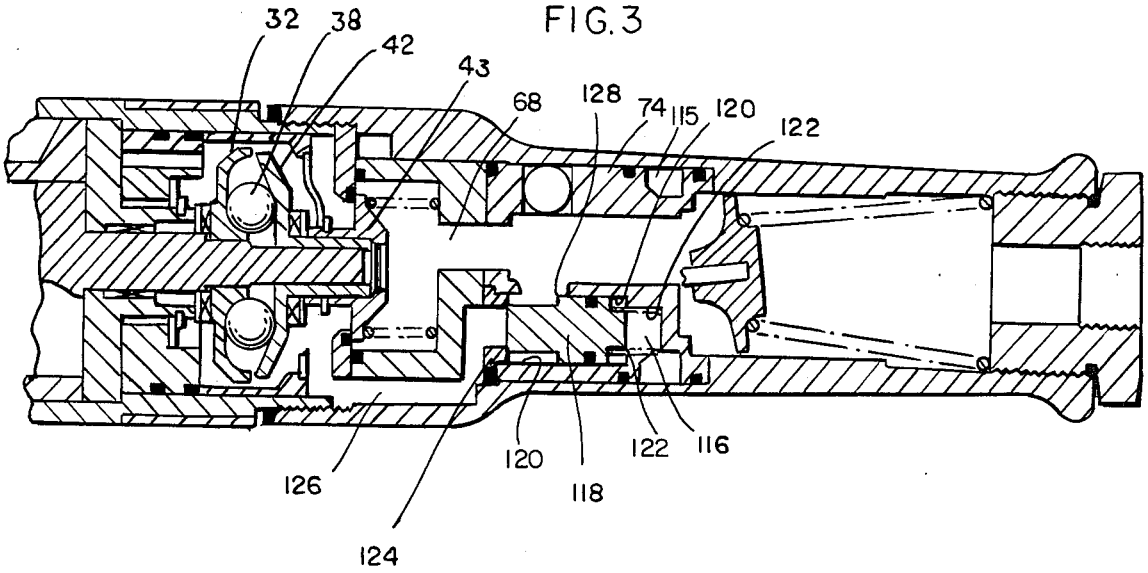
FIG. 3 is a cross sectional view of the portion of the air tool shown in FIG. 2 taken along the line 3—3 illustrating the arrangement of components of the air tool when the auxiliary inlet passage provides for passage of inlet air to the air motor.

An additional structural feature of the construction of the air tool, is exemplified by reference to FIGS. 1, 2 and 3. First referring to FIGS. 1 and 2, the bypass passage 82 connects through a restricted orifice 112 to a chamber 114 defined in the plug or body 74. The chamber 114 connects via a circumferential passage 115 with a chamber 116 as shown in FIG. 3. Chamber 116 is associated with a pilot or slide valve 118.

The slide valve 118 is a cylindrical slidable member positioned within a cylindrical passage 120 in the body 74. The pilot or slide valve 118 slides axially and is normally biased by a spring 122 so that a valve seat 124 in body 74 coacts with the slide valve 118. The seat 124 is defined at the end of a bypass passage 126 which leads from the main fluid flow passage 68 through the body 74 to the region adjacent the ball guide 32 and cam plate 40. Thus, air flow through the passage 126 will pass through the inlet 28 to operate the motor. The member 118 also has a peripheral flange 128 whereby fluid pressure within the main inlet passage in the body 74 may act against the surface of the flange 128 to translate the body 118 against the force of the spring 122.

Figure 5:
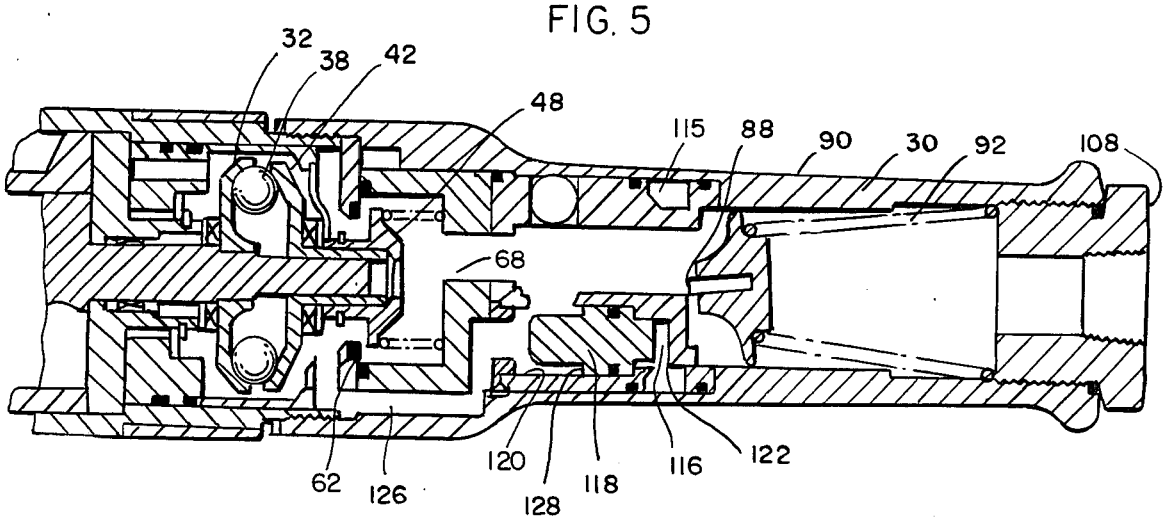
FIG. 5 is a cross sectional view similar to FIG. 4 wherein high volume and high pressure operation of the air motor has been effected in order to open the main inlet valve to the air motor when the motor is running at maximum shaft speed.

FIG. 8 depicts the construction of the groove 36 and associated slidable element 38. The ball guide 32 includes a series of five grooves in the preferred embodiment. The grooves 36 do not extend radially from the axis 16. Rather, each of the grooves 36 is arranged in a plane transverse to axis 16 and at an angle which intersects a radius extending from the axis 16. The slidable elements 38 are ball bearings which can slide within the grooves 36 between a first, lower or inner position 130 and an outer or second position 132. The bearings 38 generally move against the outside edge 134 of the groove during acceleration and deceleration of the tool. Particularly during deceleration, the edge 134 of the groove 36 acts against the bearing 38 to effectively transpose or translate the bearing 38 in the groove 36 toward the inner position 130. As the bearings 38 are transported toward the inner position 130, they are maintained in engagement against the cam surface 42 by spring 64 causing the cam surface 42 to assume the position such as depicted in FIGS. 1 and 2 wherein the valve member 48 is closed. This is the socalled first position of the valve member 48 which is a closed position. When the slidable elements or ball bearings 38 are in the outer position 132 in response to action of bearings 38 on surface 42, however, the cam surface 42 is shaped as such that the main valve member 48 is translated outwardly and axially as depicted in FIG. 5.

Operation of the Air Tool

The following description relates to a typical operation sequence of the improved air tool of the present invention. It is to be noted in this description that the output shaft 14 of the air motor which is coaxial with the shaft 14 is not depicted in the drawings. However, the output shaft of the air motor and the various mechanisms associated with such an output shaft are well known to those skilled in the art. Thus, the following description is directed principally to the control mechanism depicted in the drawings. It is also understood that the drawings which depict the product and in particular the control mechanism of the air tool in cross sectional views constitute an accurate depiction of the totality of the component parts of the air tool inasmuch as the parts are generally cylindrically in shape and the longitudinal cross sectional views thereof represent a general cross sectional configuration of the component parts.

As previously discussed, FIG. 1 represents the tool in a configuration wherein air pressure is provided to the throughbore 110 to the tool. However, the manual actuation lever 100 has not been operated and the tool is essentially at rest. Further, the control ring 26 and control sleeve 52 are in the configuration illustrated in FIG. 10. This is the configuration which permits forward operation of the air motor.

Figure 11:
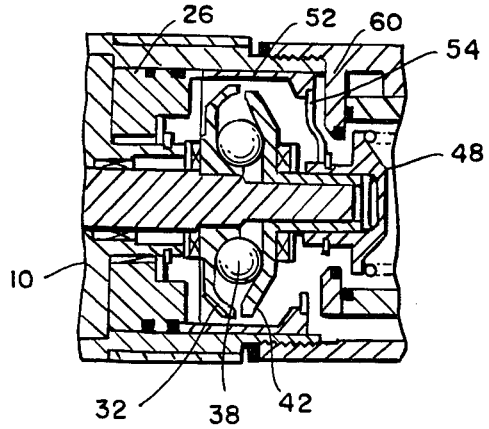
FIG. 11 illustrates an enlarged cross sectional view of the component parts of the torque control mechanism when the tool is configured for reverse operation.

In the configurations of FIGS. 11 and 12, the control ring 26 has been rotated manually in a counterclockwise sense thereby biasing the control sleeve 52 and valve member 48 to the open position permitting unimpeded air flow of pressurized air to the air motor for the reverse operation thereof. This will again be described in greater detail later.

It will be noted, therefore, the next step in the operation of the tool in the forward direction is depicted by reference to FIG. 2 and FIG. 2A. The configuration depicted by FIG. 2 and FIG. 2A is the so-called auxiliary flow mode or auxiliary air flow operation of the tool. When the tool is in this configuration, there is no air through the main valve 48 and high pressure and high volume flow of air is not provided through the air motor. Rather, auxiliary flow of air is depicted. Further, the bypass valve associated with the control mechanism is not operational. This bypass valve and the motor start mechanism will be described in greater detail below. It is only necessary to note that the bypass operation or bypass valve permits initial start up of the tool for high volume and high air flow operation.

The auxiliary flow of air depicted in FIGS. 2 and 2A is useful when an operator needs to operate a tool of this nature when the throttle valve stem 96 only partially opened to provide a few degrees of spindle or shaft 14 rotation. This feature is necessary when an operator needs to rotate the output spindle of the tool to line it up with a fastener, for example. Thus, the operator will utilize this feature by pressing the lever 100 less than halfway down in order to effect this low volume, low pressure auxiliary operation.

When the lever 100 is so pressed, the stem 88 is moved out of alignment with the axis 16. Air of fluid flow through the inlet and throughbore 110 thus flows past the valve 90 and into the body 74, and more particularly, into the main inlet or fluid flow passage 68 through the body 74. The air then flows through the second slot 106, the orifice 84 and the auxiliary passage 70 to the motor. This permits low volume, low pressure operation of the motor as described. Note that simultaneous with this particular positioning of the spool or stem 96, the second passage or slot 106, though aligned to permit a low volume of air to the air motor, does not permit any flow of air through the first slot 102. The first slot 102 is thus sized with a length that insures that even though the stem 96 is partially or slightly depressed, it will not connect with the main air flow passage 68 through the body 74. This is depicted in FIG. 2A. The slot 102 thus maintains connection of the passage 82 and orifice 80 to the atmosphere via passage 104.

Figure 4:
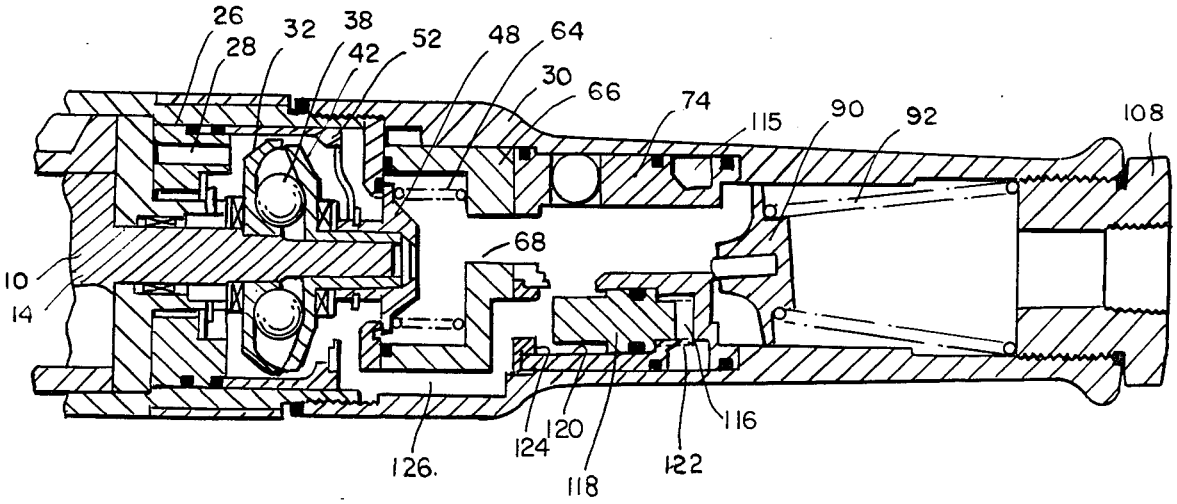
FIG. 4 is a cross sectional view similar to FIG. 3 wherein the manual control lever of the air tool has been fully depressed in order to initiate flow of pressurized fluid through the bypass passage to thereby start high pressure and high volume air flow operation of the motor.

It is noted that the passage 82 and 80 (FIGS. 2, 2A) are connected with the volume or passage 116 associated with the slide valve 118 via the chamber 114 (FIG. 2), passage 115 (FIGS. 2–4). In other words, when the tool is configured as described, in FIG. 2 atmospheric pressure and spring 122 is exerted on the valve 118 at the end adjacent chamber 116. However, the counteracting pressure on surface flange 128 via passage 68 is initially not sufficient to translate valve 118 because restriction or orifice 112 prevents pressure in chamber 116 from exhausting quickly through the passage 115, chamber 114, passage 82, and orifice 80. The valve 118 is thus maintained in position (as in FIG. 3) by spring 122 while low pressure, low volume fluid flow through passage or slot 106 and passage 70 permits very short term or momentary operation of the air motor. Release of the lever 100 permits the stem 96 to return to the position depicted in FIG. 1 and the air tool is again in the rest position.

By contrast, Full depression of the lever 100 will, after a short time interval, cause operation of the bypass valve 118 in the manner depicted in FIG. 4. That is, full depression of the lever 100 will cause the air to flow through the throughbore 110 past the valve 90 into the chamber or passage 68 defined by the body 74. Here the air from the high pressure source will be cut off from flow through the auxiliary orifice 84 since the stem 96 is now fully depressed closing off the passage 106 to the orifice 84 and passage 70. Simultaneously, however, the high pressure air will have sufficient time to act against the surface defined by the flange 128. This causes the valve member 118 to translate to the right as depicted in FIG. 4 opening the bypass passage 126 and permitting high pressure, high volume air to initiate operation of the air motor by flowing through inlet passage 28. Simultaneous with this, the first slot or passage 102 interconnects the high pressure inlet air from the interior chamber or passage 68 of the plug 74 and through orifice 80 into bypass passage 82. The air flow is, however, restricted by the restricted orifice 112 through passage 115 into chamber 114 and chamber 116. The time delay in the pressure increase in chamber 116 due to the restricted orifice 112 thus permits the immediate aforesaid initial described movement of the slide valve 118 to the right in FIG. 4 against the force of spring 122.

Figure 6:
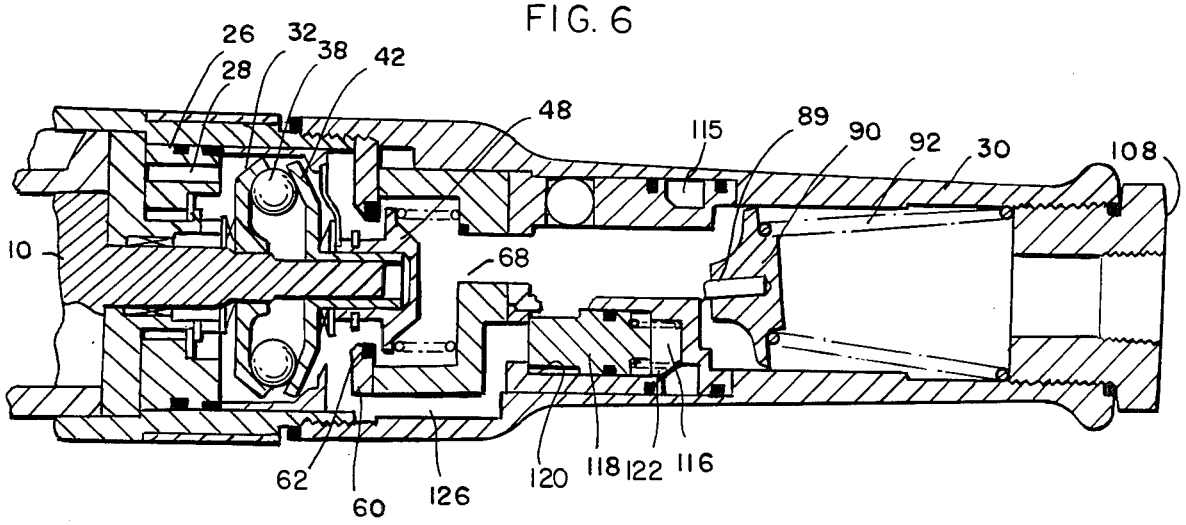
FIG. 6 is similar to FIG. 5 and illustrates the manner by which the bypass inlet passage is closed following start up of the air motor.

After a sufficient time delay, however, pressure will build up in the chamber 116 due to high pressure flow through the restricted orifice 112 causing the slide valve 118 to return to its original position. This is depicted in FIG. 6. By the time that the valve 118 returns, however, the air motor has commenced to operate at full speed. This causes the slidable elements or ball bearings 38 to slide outward in associated grooves 36 to their outer position in the manner previously described. The elements 38 thus engage against the cam surface 42 forcing the main valve member 48 to the open position again as depicted in FIG. 6 against the force of the spring 64 and the force of the inlet air on the main valve member 48. Air flow then passes over the main valve member 48 and into the air motor.

As the tool, however, is operated and begins to engage resistance and thus provide a torque or turning force against the fastener, for example, the speed of the air motor is diminished. As this speed is diminished indicating increased torque, the deceleration forces action on the elements 38 will cause those elements to engage the edges 134 and slide toward the inner position 130 in the manner previously described.

Figure 7:
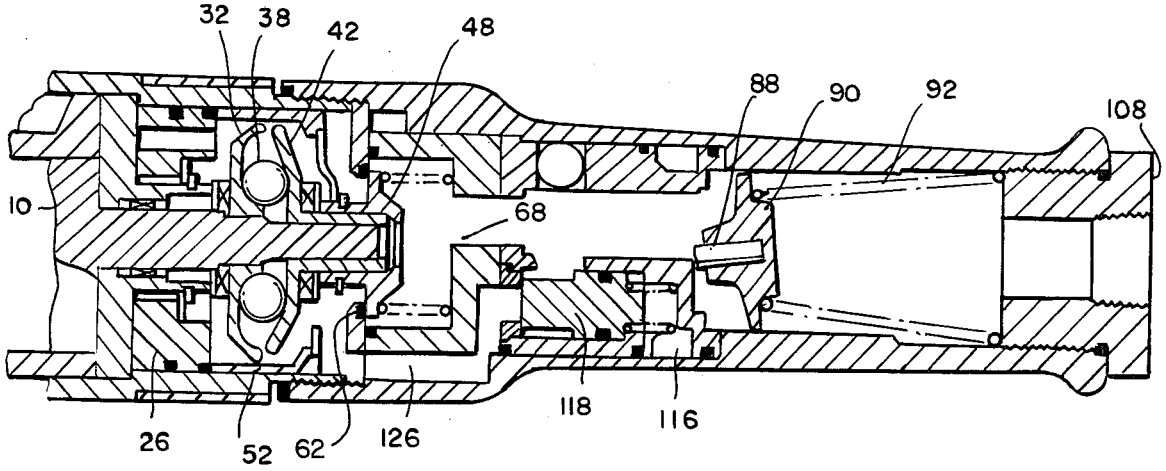
FIG. 7 is similar to FIG. 6 and illustrates the mechanism for sensing torque applied by the tool and for termination of air flow through the main flow inlet passage to the tool.

As the elements 38 slide to the inner position 130 from the outer position 132, the cam surface 42 cooperates with those elements 38 permitting the main valve member 48 to close or assume the position depicted in FIG. 7. The air tool then automatically terminates operation and will not recommence operation until the hand lever 100 is released for a sufficient time period to permit pressure in the chamber 116 on the back side of the slidable valve 118 to exhaust through orifice 112 and reach atmospheric pressure. The cycle may then again be repeated on the next fastener. The next operation may, in other words, be performed by the tool.

With this particular construction, it is possible to accurately control the amount of torque applied to a fastener. A present mechanism is designed to compensate for high rates of deceleration and thereby reduce overtorqueing of so-called hard joint fasteners. That is, with higher rates of deceleration, because the grooves 36 are inclined rather than radial with respect to the axis 16, the interaction of the edges 134 of the grooves 36 with the elements or bearings 38 permits greater control of torque particularly during high deceleration situations. Greater consistency in application of fasteners, for example, by use of such a tool is provided.

FIGS. 9, 10, 11 and 12 illustrate the mechanism by which the torque control is eliminated during reverse operation of the air tool. Thus, when the control ring 26 is rotated in the manner previously described, cam surfaces on the perimeter of ring 26 engage cam surfaces on the perimeter of control sleeve 52 causing the arms 54 of sleeve to engage against the ring 56 and translate the hub 58 and attached valve member 48 to the open position as illustrated in FIG. 11. When in this position, flow of inlet air past the valve member 48 permits high speed, reverse operation of the tool without torque control.

While there has been set forth a preferred embodiment of the invention, it is to be understood that the invention is to be limited only by the following claims and their equivalents.

What is claimed is:

1. In a fluid driven tool of the type having a housing, a fluid driven motor with a rotary shaft defining an axis, a fluid inlet passage to the motor, and a fluid control valve mechanism in the inlet passage, the improvement comprising:

an automatic fluid shut-off mechanism in the inlet passage responsive to acceleration and speed, said mechanism including:

a guide member coaxial with and keyed to the rotary shaft for rotation therewith, said guide member having a face with at least one guide groove, said groove defining a path which intersects a radius extending from the axis an element slidable in the guide groove between an inner position adjacent the axis and an outer position in response to acceleration forces thereon, a plate member defining a cam surface coaxial with and positioned against the slidable element and movable generally parallel to the axis in response to movement of the element in the groove against the cam surface; said plate member movable between a first position corresponding to the inner position of the element and a second position corresponding to the outer position of the element;

a main valve member coaxial with and connected to the plate member in the inlet passage;

a main valve seat coaxial with and cooperative with the main valve member to close the inlet passage whenever the plate member and attached main valve member are moved axially to the first position and to otherwise open the inlet passage; and means for reversing the operation of the motor, said means for reversing including means for engaging and translating the main valve member axially from the main valve seat and for maintaining the main valve member unseated from the main valve seat whereby reverse operation of the motor is under full throttle without torque control.

2. The tool of claim 1 wherein the means for reversing comprise manually actuated cam means cooperative with a cam actuated control ring coaxial with the main valve member and connectable to the main valve member to effect axial movement thereof in response to cam means engagement with the ring.

3. In a fluid driven tool of the type having a housing a fluid driven motor with a rotary shaft defining an axis, a fluid inlet passage to the motor, and a fluid control valve mechanism in the inlet passage, the improvement comprising:

an automatic fluid shut-off mechanism in the inlet passage responsive to acceleration and speed, said mechanism including:

a guide member keyed to the rotary shaft for rotation therewith, said guide member having a face with at least one guide groove, said groove defining a path which intersects a radius extending from the axis an element slidable in the guide groove between an inner position adjacent the axis and an outer position in response to acceleration forces thereon, a plate member defining a cam surface positioned against the slidable element and movable generally parallel to the axis in response to movement of the element in the groove against the cam surface; said plate member movable between a first position corresponding to the inner position of the element and a second position corresponding to the outer position of the element;

a main valve member connected to the plate member in the inlet passage;

a main valve seat cooperative with the main valve member to close the inlet passage whenever the plate member and attached main valve member are moved to the first position and to otherwise open the inlet passage; and a manually operated fluid inlet and bypass valve mechanism to initially bypass the main valve member and direct pressurized fluid directly to the motor to initiate operation of the motor, said fluid inlet and bypass valve mechanism including:

a manually operable inlet valve assembly with a first valve upstream from the main valve member in the inlet, a parallel fluid passage connecting the inlet passage directly to the motor from the downstream side of the first valve;

a second pilot valve, said second pilot valve normally closing the parallel fluid passage and having its downstream side directly in communication the fluid motor, the upstream side of the pilot valve connected through a flow control orifice to the inlet passage downstream from the first valve, whereby a differential pressure results on opposite sides of the pilot valve to operate the pilot valve initially upon actuation of the manually operable inlet valve to the open position for fluid to flow directly to the motor, and subsequently to switch the pilot valve to the closed position after the motor has operated at a sufficient speed to effect opening of the main valve member by cooperation of the slidable element on the cam surface.

4. The improvement of claim 1 in further combination with an auxiliary fluid flow control mechanism for providing reduced volume and pressure fluid to the motor, said auxiliary mechanism including:

an auxiliary passage from the manually operable inlet valve assembly to the motor, an auxiliary slide valve for connecting the inlet passage to the auxiliary passage, a manual actuator for the auxiliary slide valve, and means incorporating the manual actuator in the manually operable inlet valve assembly for rendering the auxiliary flow control mechanism operable when the bypass valve mechanism is inoperable.

5. The improvement of claim 1 including means for reversing the operation of the motor, said means for reversing also including means for maintaining the main valve member unseated from the main valve seat whereby reverse operation of the motor is under full throttle without torque control.

* * * * *